US005270511A

United States Patent [19]

Iguchi

[11] Patent Number: 5,270,511

[45] Date of Patent: Dec. 14, 1993

[54] LOW-FREQUENCY INDUCTION HEATER EMPLOYING STAINLESS STEEL MATERIAL AS A SECONDARY WINDING

[75] Inventor: Atsushi Iguchi, Kyoto, Japan

[73] Assignee: Nikko Corporation Ltd., Kyoto, Japan

[21] Appl. No.: 803,586

[22] Filed: Dec. 9, 1991

[30] Foreign Application Priority Data

Jun. 5, 1991 [JP] Japan ..... 3-134451

[51] Int. Cl.[5] ..... H05B 6/40

[52] U.S. Cl. ..... 219/10.491; 219/10.51; 219/10.75; 219/10.79

[58] Field of Search ..... 219/10.75, 10.51, 10.491, 219/10.493, 10.79, 10.77

[56] References Cited

U.S. PATENT DOCUMENTS

| | | | |
|---|---|---|---|
| 1,362,622 | 12/1920 | Hendricks et al. . | |
| 2,673,921 | 3/1954 | Schorg . | |
| 3,307,008 | 2/1967 | Schroeder . | |
| 3,440,384 | 4/1969 | Schroeder | 219/10.491 |
| 4,136,276 | 1/1979 | Ashe | 219/10.51 |
| 4,195,214 | 3/1980 | Gerber | 219/10.79 |
| 4,303,826 | 12/1981 | Ando | 219/10.51 X |
| 4,331,854 | 5/1982 | Balordi | 219/10.51 |
| 4,532,398 | 7/1985 | Henriksson | 219/10.79 |
| 4,560,849 | 12/1985 | Migliori et al. | 219/10.51 |
| 4,602,140 | 7/1986 | Sobolewski . | |
| 4,874,916 | 10/1989 | Burke | 219/10.75 |
| 5,061,835 | 10/1991 | Iguchi | 219/10.79 |

FOREIGN PATENT DOCUMENTS

| | | |
|---|---|---|
| 0383272 | 8/1990 | European Pat. Off. . |
| 635977 | 9/1936 | Fed. Rep. of Germany . |
| 56-86789 | 7/1981 | Japan . |
| 58-39525 | 8/1983 | Japan . |
| 1142132 | 2/1965 | United Kingdom . |

*Primary Examiner*—Philip H. Leung
*Attorney, Agent, or Firm*—Fish & Richardson

[57] ABSTRACT

A low-frequency induction heater includes a primary side coil having a core and a secondary side conductive hollow cylindrical member surrounding the primary side coil. An improvement to the Joule heat generation efficiency and a solution to problems peculiar to composite materials, such as thermal deformation, electrolytic corrosion, and difficulty is sought of manufacture by forming the conductive hollow cylindrical member of a sole stainless steel material of a thickness ranging from 2 mm to 6 mm. In a preferred embodiment, a coil 2 is wound around a rod-like core 1, which is in turn surrounded by a conductive hollow cylindrical member 3 made of a sole stainless steel material of a thickness ranging from 2 mm to 6 mm. When an AC current passes through the coil 2, an alternating magnetic field is set up in the axial direction of the coil 2, which causes an inducted current in the conductive hollow cylindrical member 3. Joule heat is thus generated in the member 3 due to the electric resistance thereof.

19 Claims, 8 Drawing Sheets

The Conductive Hollow Cylindrical Member Temperature Detection System

The Oil Temperature Detection System

LOW-FREQUENCY INDUCTION HEATER EMPLOYING STAINLESS STEEL MATERIAL AS A SECONDARY WINDING

BACKGROUND OF THE INVENTION

1. Field of the Invention

This invention relates to a low-frequency induction heater utilizing a one-turn transformer s an electromagnetic induction heat generator and, more particularly, to a low-frequency induction heater which comprises a secondary conductive hollow cylindrical member of a sole stainless steel material.

2. Background of the Invention

Heretofore, an electric fryer has been proposed which comprises an oil container, a pipe-like portion formed substantially in a central portion of the oil container, and an induction heater inserted in the pipe-like portion with a gap provided by means of positioning ridges, as disclosed in Japanese Examined Patent Publication (Kokoku) No. 39,525/1983.

Meanwhile, the inventor of the present invention earlier proposed a low-frequency electromagnetic induction heater, comprised of an induction coil wound on a core, and a single metal pipe or two or more different metal pipes combined into an integrated structure around the induction coil, where the gap between the induction coil and the pipe or pipes is filed with a resin molding, as disclosed in Japanese Unexamined Patent Publication (Kokai) No. 297,889/1990.

However, in the former heater, i.e., the electric fryer, heat generated from the induction heater is transferred to the pipe-like portion, which is a part of the oil container, through the air gap between the induction heater and the pipe-like portion which causes the problem of low heat transfer efficiency. Therefore, when oil in the container is heated to the cooking temperature necessary for cooking fries, tempuras, or the like, the temperature of the induction heater is raised to a considerably high temperature, which has an adverse effect on the coil and the core of the induction heater. Particularly, the temperature of the induction heater is liable to exceed the acceptable temperature limit of the coil insulator.

In the latter heater, i.e., the low-frequency electromagnetic induction heater, the secondary winding is a part of the container. Thus, Joule heat is generated by electromagnetic induction in the container. This achieves the advantage that satisfactory energy transfer efficiency can be obtained by avoiding an excessive temperature rise in the coil and the core. However, where the secondary winding uses; a combination of copper, which has a low electric resistivity, and stainless steel which is durable, i.e., where a copper pipe and a stainless steel pipe (a part of the vessel) are combined into an integrated structure, the heater has the following disadvantages:

(1) When the overall pipe structure is heated and the temperature is raised, the difference in the coefficient of thermal expansion between the two metals causes circumferential elongation of the copper pipe relative to the stainless steel pipe, in other words, a portion of the circumference of the copper pipe expands inward to produce an air gap between the inner copper pipe and the outer stainless steel pipe. In the portion where the air gap is produced, the heat transfer efficiency deteriorates and localizes the temperature rise, which causes oxidation of the copper. FIGS. 11(*a*) and 11(*b*) are sectional views showing gap formation. Before the temperature rise, the copper pipe 21 and the stainless steel pipe 22 are perfectly integrated FIG. 11(*a*)). After the temperature rise, however, an air gap 23 is formed between the two pipes 21 and 22 (FIG. 11(*b*)).

(2) If a leakage current, e.g., a grounding current, is caused in the heater while there is water on the contact portions of the copper and stainless steel pipes, electrolytic corrosion occurs about which deteriorates the secondary winding.

(3) For combining the copper pipe and stainless steel pipe into an integrated structure, high dimensional accuracy is required in the shapes of both the pipes, and this inevitably leads to increased manufacturing cost.

(4) In case the integrated structure of a copper pipe and a stainless steel pipe is used as a secondary winding, the number in layers of a primary winding increases from 4 layers to 6 layers. This means that heat dissipation from the inside of the primary winding is difficult, which eventually causes overheating in the primary winding.

SUMMARY OF THE INVENTION

To solve the above problems, it is the primary object of this invention to provide a low-frequency induction in which heater the secondary winding is made of a sole stainless steel material.

It is another object of this invention to provide a low-frequency induction heater with a high efficiency of energy transfer to the cooking material.

It is yet another object of this invention to provide a low-frequency induction heater in which the rate of temperature rise is rapid.

It is yet another object of this invention to provide a low-frequency induction heater which can prevent a localized temperature rise.

It is yet another object of this invention to provide a low-frequency induction heater which can prevent strain, deformation or electrolytic corrosion to a satisfactory life and durability.

It is yet another object of this invention to provide a low-frequency induction heater which permits cooking at a stabilized temperature.

It is yet another object of this invention to provide a low-frequency induction heater which prevents deterioration of the cooking oil and extends its period of use.

The present invention has ben provided in order to accomplish the above objects. A low-frequency induction heater according to the invention has the following construction:

A low-frequency induction heater comprising a primary winding coil with a core and a secondary winding conductive hollow cylindrical member surrounding the primary winding coil, there the conductive hollow cylindrical member is made solely of stainless steel material of a thickness in a range of 2 mm to 6 mm.

It is preferable in the above aspect of the present invention that a temperature sensor is provided inside the conductive hollow cylindrical member.

It is preferable in the above aspect of the present invention that the number of layers of the primary winding coil is ranges from 1 layer to 2 layers.

It is preferable in the above aspect of the present invention that the core has the shape of a coil laminated of a high magnetic permeability material plate and a slit along the axial direction.

It is preferable in the above aspect of the present invention that the core is made of silicon steel plate.

It is preferable in the above aspect of the present invention that the outer diameter of the core ranges from 10 mm to 200 mm.

It is preferable in the above aspect of the present invention that the length of the core ranges from 10 mm to 2,000 mm.

It is preferable in the above aspect of the present invention that the primary winding coil is made of aluminum wire.

It is preferable in the above aspect of the present invention that the diameter of the wire in the primary winding coil 2 mm to 8 mm.

It is preferable in the above aspect of the present invention that the number of turns of the wire in the first layer of in the primary winding coil is in a range of 50 turns to 200 turns.

It is preferable in the above aspect of the present invention that the number of turns of the wire in the second layer of the primary winding coil ranges from 10 turns to 70 turns.

It is preferable in the above aspect of the present invention that the length of the secondary winding conductive hollow cylindrical member ranges from 100 mm to 2,000 mm.

It is preferable in the above aspect of the present invention that the outer diameter of the secondary winding conductive hollow cylindrical member ranges from 30 mm to 300 mm.

It is preferable in the above aspect of the present invention that the temperature sensor is a thermocouple.

It is preferable in the above aspect of the present invention that the temperature sensor is provided inside an upper portion of the secondary winding conductive hollow cylindrical member.

It is preferable in the above aspect of the present invention that the electric power supplied to the primary winding coil is switched on or off at the zero crossing point of the voltage or current.

BRIEF DESCRIPTION OF THE DRAWINGS

FIG. 5(*a*) is a plan view and FIG. 5(*b*) is a front view.

FIG. 8(*a*) is a diagram where a single-phase AC current is passed through a single coil . FIG. 8(*b*) is a diagram where a three-phase AC current is passed through three coil sin Y-connection, and FIG. 8(*c*) being a diagram in case of passing a three-phase AC current through three coils in delta-connection.

FIG. 11(*a*) shows the pipes before a temperature rise and FIG. 11(*b*) shows the pipes after the temperature rise.

DETAILED DESCRIPTION OF THE INVENTION

Figure 1:
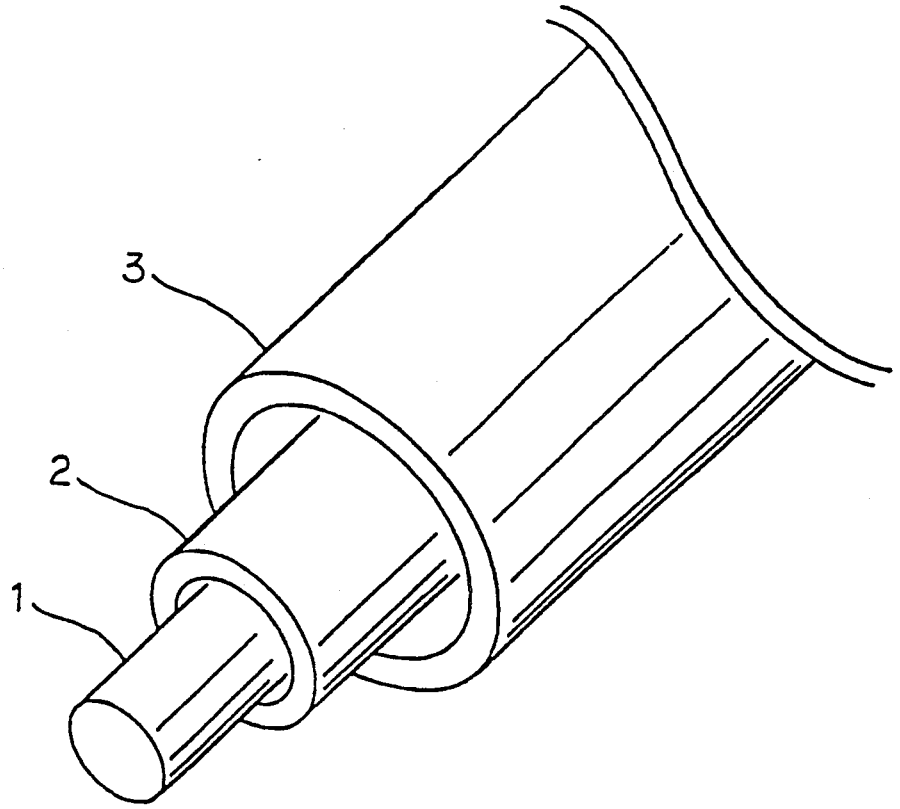
FIG. 1 is a fragmentary perspective view showing an embodiment of the present low-frequency induction heater according to the invention.

According to the present above aspects of the invention, the conductive hollow cylindrical member as the secondary winding constitutes a part of the container, and Joule heat is generated directly in the container by electromagnetic induction. Thus, satisfactory efficient energy transfer to cooking materials in the vessel is obtained. Also, is obtained the temperature rise in the coil and the core can be minimized. Further, since the conductive hollow cylindrical member is made solely of a stainless steel material, a uniform coefficient of thermal expansion is achieved which precludes strain or deformation due to the rise in temperature. Further, when a leakage current occurs when water or the like is on to the conductive hollow cylindrical member, the member is not electrolytically corroded because it is made of a single material.

Compared to the secondary winding structure of the prior art obtained by integrating a copper pipe with a thickness of 0.5 mm to 1 mm and a stainless steel pipe of a thickness of 1 mm, according to the invention is able to prevent the efficiency of Joule heat generation by electromagnetic induction from decreasing because the structure of the conductive hollow cylindrical member as the secondary winding, which is made of stainless steel, is thick, and has a large sectional area, provides low electric resistance.

Particularly, in the case where the primary side of the heater is connected to a commercial power source, where the input voltage of the primary side is set at predetermined voltage, e.g., 100 V or 200 V in Japan, with the electric resistance of the secondary side increasing, induction current of the secondary side tends to be reduced, and the power factor of the primary side tends to be reduced to increase reactive power. In order to increase Joule heat generation in the secondary side, it may be though to (1) reduce electric resistance of the secondary side, (2) reduce the number of turns of the primary side, or (3) combine (1) with (2).

However, an excessive increase in the thickness of the conductive hollow cylindrical member leads to disadvantages with regard to manufacture, cost and weight of the low-frequency induction heater.

Therefore, from the standpoints of the Joule heat generation, product costs, etc. the thickness of the conductive hollow cylindrical member appropriately ranges from 2 mm to 6 mm. Further, since the commercial power supply frequency (i.e., 50 or 60 Hz) is used, the skin effect that is observed in high-frequency induction heating does not have substantial influence, and Joule heat is generated uniformly over the entire cross section no matter how thick the conductive hollow cylindrical member.

Further, when the thickness of the conductive hollow cylindrical member is increased, it is possible to bury a temperature sensor or the like in the member to detect the temperature thereof. It is further possible to maintain a constant heating temperature of the conductive hollow cylindrical member through control of the primary winding current or voltage by comparing the temperature sensor output to a predetermined reference level.

Further, for the secondary winding, a standard stainless steel pipe available in the market may be used. Since this pipe is available inexpensively, the cost of the product can be reduced.

Further, with a low-frequency induction heater, which uses such a conductive hollow cylindrical member as a part of the cooking vessel, satisfactory energy transfer efficiency can be obtained. Because it also has a large contact area with water or oil in the container, quick heating can be obtained while preventing a localized temperature rise. Accordingly, it is possible to suppress oxidation of oil and generation of oil mist due to high temperature and also reduce the time interval from the start of energization until it is ready to cook.

Further, by using stainless steel for the entire cooking vessel including the conductive hollow cylindrical member, the cooking vessel is less corroded by cooking materials containing salt, acid or alkali.

Further, because the number of layers of the primary winding coil ranges from 1 layer to 2 layers, it is possible to minimize the temperature rise of the primary winding due to heat generated inside of the primary winding. Thus, it is possible to prevent an accident caused by defective insulation of a insulator in the primary winding.

Now, embodiments of the low-frequency induction heater according to the invention will be described with reference to the drawings.

Figure 2:
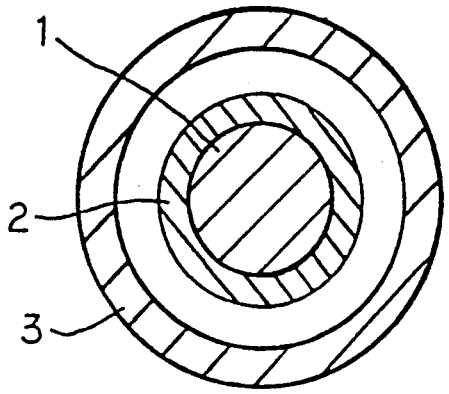
FIG. 2 is a sectional view showing the embodiment of the low-frequency induction heater.

FIG. 1 is a fragmentary perspective view showing an embodiment of the low-frequency induction heater according to the present invention and FIG. 2 is a sectional view of the same.

A coil 2 is wound around a cylindrical core 1, and a conductive hollow cylindrical member 3 made solely of stainless steel material is placed around the coil 2.

When an AC current of 10 A (rms) with a voltage of 100 V (rms) at a frequency of 50 or 60 Hz passes through the coil 2 which has 100 turns as the primary winding of the transformer, an alternating magnetic field occurs in the axial direction of the coil 2 and a magnetic circuit is formed in the core 1, which is made of a high magnetic permeability material. The conductive hollow cylindrical member 3 surrounding the coil 2 functions as the secondary side of the transformer, and an induction current is generated in the member 3 in accordance with the time differential of the alternating magnetic field.

In the absence of loss peculiar to the transformer, an induction current of 1,000 A (rms) at a voltage of 1 V (rms) flows in the secondary winding with a turn ratio of primary to secondary of 100 to 1. This induction current is converted by the electric resistance of the conductive hollow cylindrical member 3 into Joule heat, thus heating the member 3. In thermal contact with an object and the heated member 3, the object can receive heat from the member 3 and be heated.

The energy transfer between the coil 2 and the conductive hollow cylindrical member 3 is mostly effected by the alternating magnetic field, and therefore an air gap may be present between the coil 2 and member 3. Particularly, when heating oil or a similar object up to a high temperature, the acceptable temperature of the insulation of the coil 2 is liable to be exceeded due to transfer of heat from the conductive hollow cylindrical member 3 to the core 1 and coil 2, and therefore it is appropriate that an air gap is provided between the coil 2 and member 3. Where there are losses peculiar to the transformer, typically hysteresis loss and eddy current loss in the core 1 and copper loss due to the resistance of the coil 2, the core 1 and the coil 2 are liable to be elevated to a high temperature due to heat generation. In such a case, they are cooled by supplying air to the gap.

The conductive hollow cylindrical member 3, as noted above, is preferably made solely of a sole stainless steel material with a thickness ranging from of 2 mm to 6 mm. In this case, by reducing the number of turns of the primary side coil, amount of the generated Joule heat may be increased by increasing the secondary side induction current. In addition, a reduction of in the number turns in coil can result in a reduction of the price of the low-frequency induction heater.

A preferred embodiment of the present low-frequency induction heater according to the invention will be described.

Figure 12:
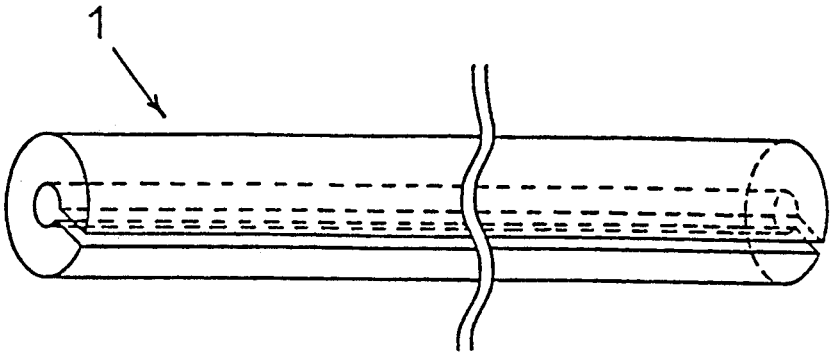
FIG. 12 is a perspective view showing a core of the low-frequency induction heater according to the present invention.

FIG. 12 is a perspective view showing a core of a low-frequency induction heater according to the present invention. The core 1 may be manufactured as follows: a high magnetic permeability material plate such as silicon steel plate is laminated by foaming a coil shape, and fixed by a filling adhesive such as resin between each layer to form an overall cylindrical shape. Then, a slit is made along the axial direction. The slit prevents induction current loss due to magnetic flux passing inside the core along the axial direction.

The shape of the core 1 may be determined with consideration for to desing matters such as inner diameter and length of the conductive hollow cylindrical member 3, turn number and shape of the coil 2, quantity of magnetic flux passing inside core, consumption power, etc. The outer diameter of the core 1 preferably ranges from 10 mm to 200 mm, most preferably from 55 mm to 70 mm. The inner diameter of the core 1 is preferable 50 mm or less, most preferably 20 mm or less. The width of the slit in the core 1 preferably ranges from 0.5 mm to 10 mm, most preferably from 1 mm to 5 mm. The length of the core 1 preferably ranges from 100 mm to 2,000 mm, most preferably from 350 mm to 500 mm.

Figure 13:
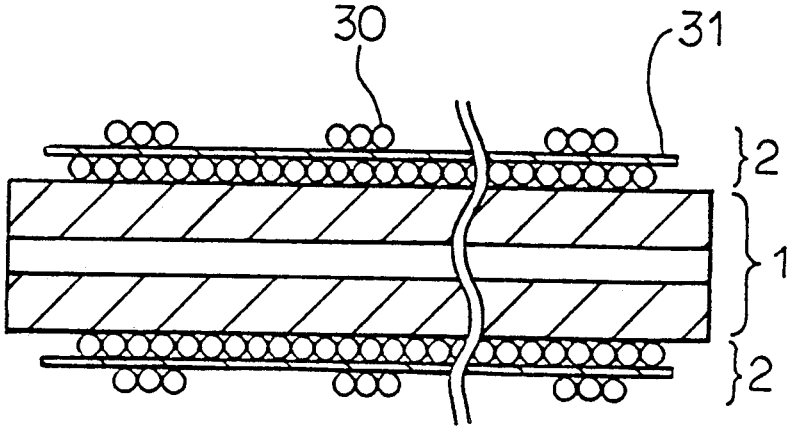
FIG. 13 is a sectional view showing a primary winding coil around the core shown in FIG. 12.

FIG. 13 is a sectional view showing a primary winding coil around the core shown in FIG. 12. A wire 30 of the coil 2 is made of aluminium wire (ALO) which has a low electric resistance and a high permissible temperature; a diameter preferably ranging from 2 mm to 8 mm, preferably most preferrably in a range from 4 mm to 6 mm. The number of layers of the coil 2 ranges from 1 layer to 2 layers. It is also preferable that winding density varies between that first layer and second layer and/or the winding density varies partly in each layer. The wire in the first layer of the coil 2 is wound densely around the side face of the core 1. The number of turns preferable ranges from 50 turns to 200 turns, most preferably, from 80 turns to 120 turns. The wire in the second layer of the coil 2 is wound sparsely on an insulating sheet 31, made of mica foil or the like around the side face of the first layer. The preferable number of turns preferrably in a ranges from 10 turns to 70 turns, most preferably from 20 turns to 40 turns.

Thus, because the number of layers of the primary winding coil is from 1 layer to 2 layers, it is possible to minimize the temperature rise of the primary winding due to heat generated inside the primary winding. For instance, if water is to be boiled continuously for 12 hours using the low-frequency induction heater according to the present invention, the temperature of the inside of the primary winding coil reaches only 185° C. Meanwhile, if is to be boiled continuously using another low-frequency induction heater where the number of layers of the primary winding coil is 5 layers, the temperature of the inside of the primary winding coil reaches 499° C., which is near the melting point of the aluminium wire after the beginning of energizing.

The core 1 with the primary winding obtained as noted above, is positioned about the center of the conductive hollow cylindrical member 3 shown in FIG. 1. The shape of the conductive hollow cylindrical member 3 may be determined with consideration to design matters such as electric resistance, calorific power, consumption power, shape of heating cooking device, etc. It is preferable that the conductive hollow cylindrical member 3 as a part of the cooking vessel, as noted above, is made solely of stainless steel material such as SUS316, SUS304, etc. (Japanese Industrial Standard G 4303~4316) and the thickness range from 2 mm to 6 mm, most preferably 2.5 mm to 4 mm. The length of the conductive hollow cylindrical member 3 preferably ranges from 100 mm to 2,000 mm, most preferably, from 40 mm to 500 mm. The outer diameter of the conductive hollow cylindrical member 3 preferably ranges from of 30 mm to 300 mm, most preferably from 80 mm to 120 mm.

Figure 3:
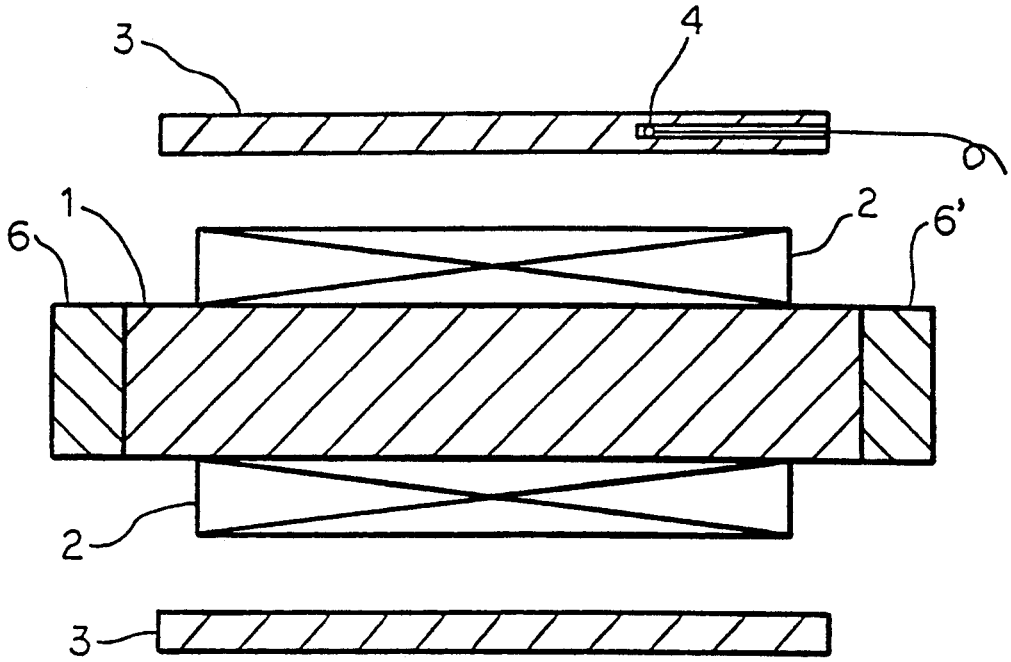
FIG. 3 is a sectional view showing a low-frequency induction heater according to the present invention, which has a temperature sensor buried inside a conductive hollow cylindrical member.

FIG. 3 is a sectional view showing a low-frequency induction heater according to the present invention, which has a temperature sensor provided inside a conductive hollow cylindrical member.

A temperature sensor 4 such as a thermocouple is inserted and secured in an elongated bore formed in a part of the conductive hollow cylindrical member 3. The temperature sensor 4 detects the temperature of the conductive hollow cylindrical member 3 and outputs, for instance, a voltage signal proportional to the detected temperature.

Conventionally, because the temperature sensor 4 was disposed outside the conductive hollow cylindrical member 3 and inside the vessel (e.g., in the heated oil in electric frier), the sensor was liable to be broken during the cooking operation. Meanwhile, according to the invention, the temperature sensor 4, which is inserted inside the conductive hollow cylindrical member 3, never obstructs the cooking operation or cleaning operation, and can prevent the operator from damaging the temperature sensor 4 by mistake.

The position of the temperature sensor 4 inside the conductive hollow cylindrical member 3 is preferably in an upper portion of the member 3. This is so that the operator can clean the outer side of an upper portion of the conductive hollow cylindrical member 3 when the operator removes scales or stains on the member 3. This means that it is possible to avoid erroneous operation of the temperature sensor due to attached scales.

Figure 4:
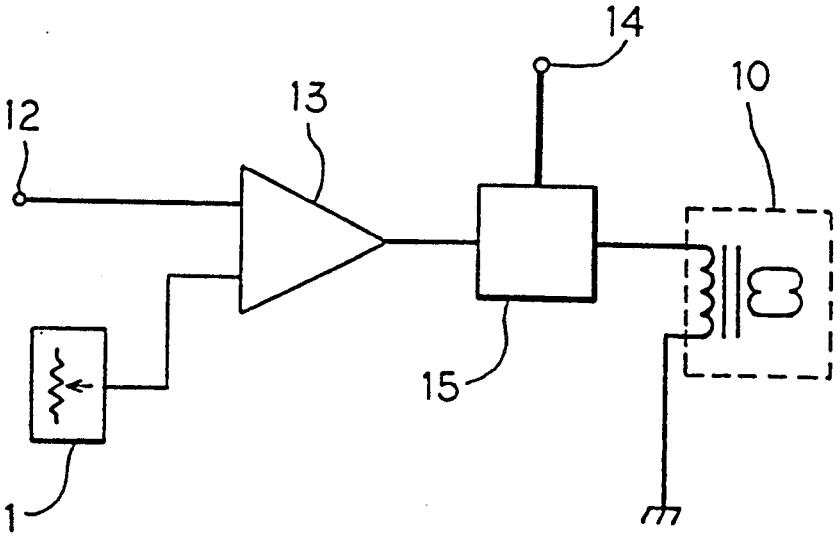
FIG. 4 is a schematic representation of an example of a temperature control circuit.

FIG. 4 is a schematic representation of a temperature control circuit. The output of the temperature sensor 4 is amplified to a predetermined level by an amplifier (not shown) and then coupled to an input terminal 12, and thence to a comparator 13. Meanwhile, a signal from a reference signal generator 11, which provide a reference level corresponding to a predetermined temperature, is coupled to the comparator 13 for comparison of the two signals. Power supplied from a power supply terminal 14 to the low-frequency induction heater 10 is on-off controlled by a switching element 15. The power supplied to the low-frequency induction heater 10 is turned off when the temperature of the conductive hollow cylindrical member 3 exceeds the reference temperature and turned on when the hollow cylindrical member temperature is lower than the reference temperature. In this way, the heating temperature of the conductive hollow cylindrical member is stabilized in the neighborhood of the reference temperature. When the primary side input power is high, the on-off switching is suitably effected at the zero crossing point of the voltage or current in order to prevent noise or surges.

The above temperature control circuit used in the low-frequency induction heater according to the present invention is by no means the only one possible. It is possible to use other temperature control circuits well-known to skilled persons.

Now, a low-frequency induction heating cooking device incorporating the low-frequency induction heater according to the present invention will be described.

Figure 5A:
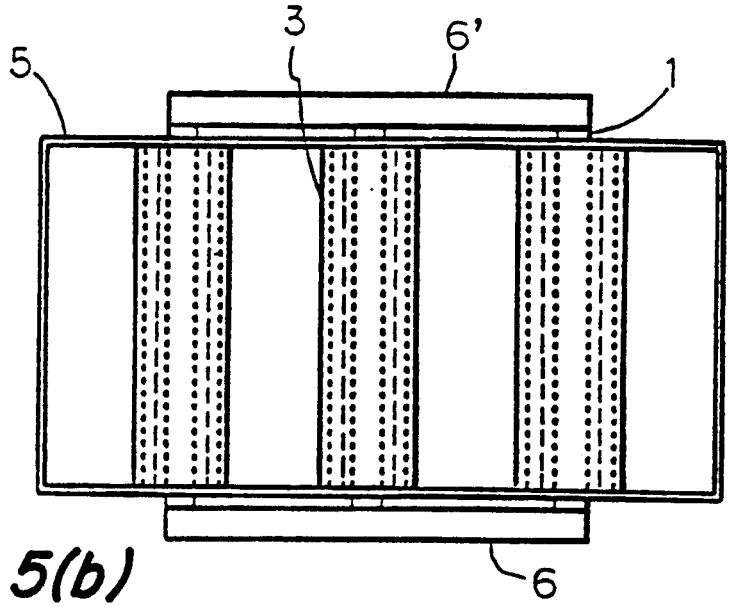
FIGS. 5(*a*) and 5(*b*) show an example of a low-frequency induction heating cooking device using the low-frequency induction heater according to the present invention.
Figure 5B:
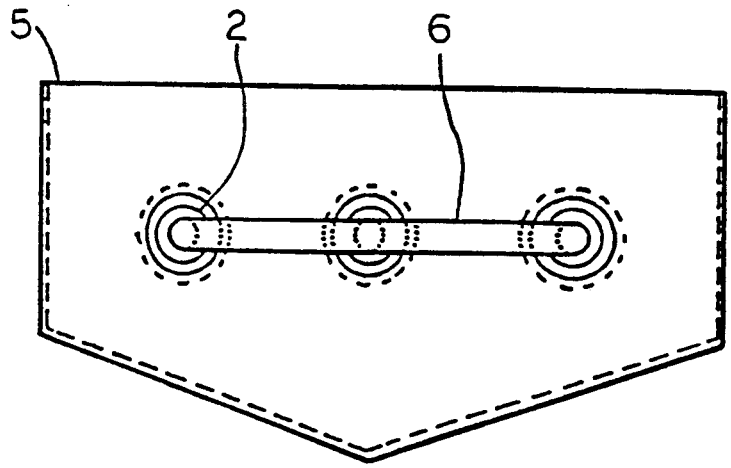

FIGS. 5(*a*) and 5(*b*) show an example of the low-frequency induction heating cooking device using the low-frequency induction heater according to the present invention, FIG. 5(*a*) is a plan view and FIG. 5(*b*) is a front view.

Figure 6:
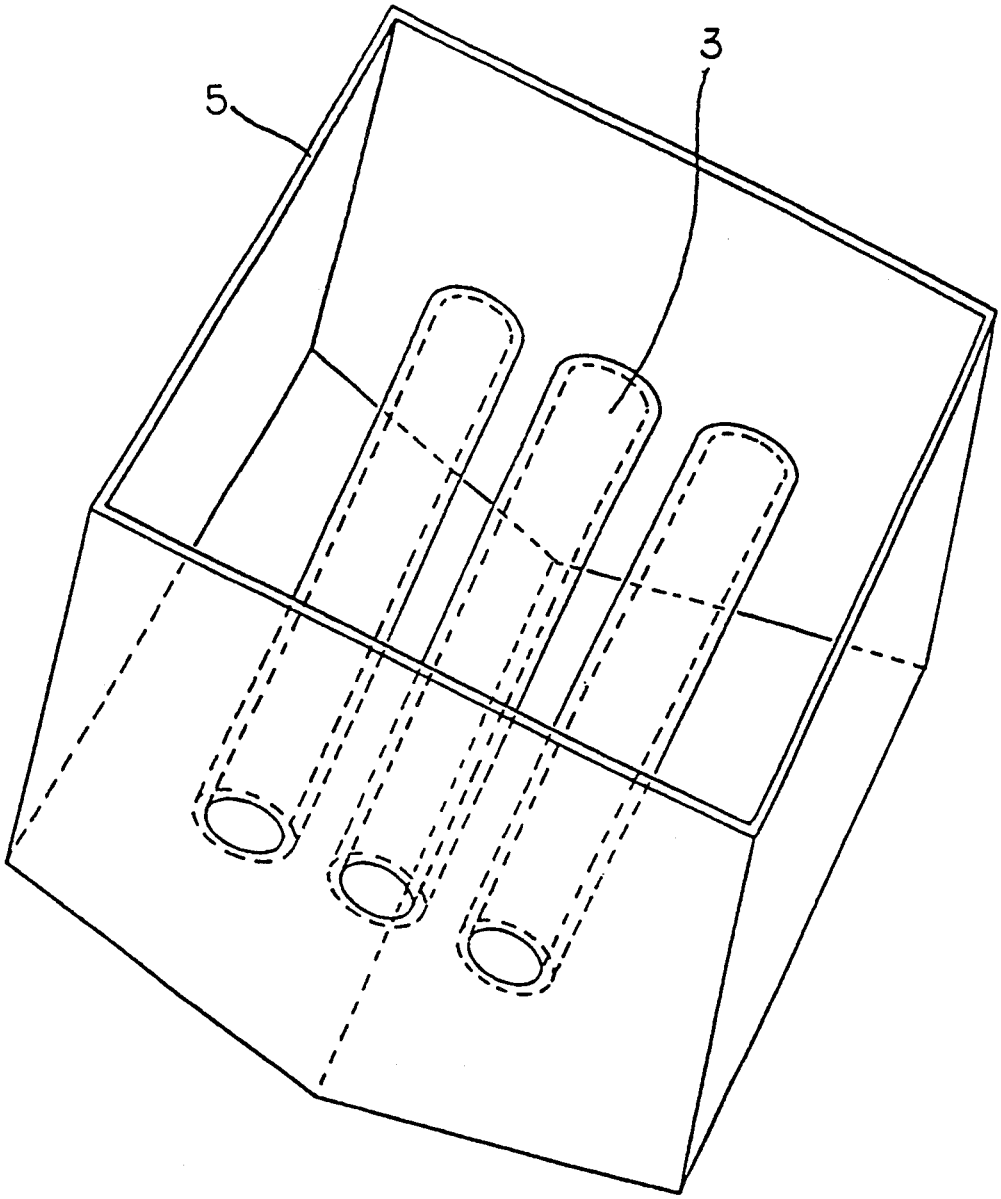
FIG. 6 is a perspective view showing the low-frequency induction heating cooking device using the low-frequency induction heater according to the present invention.
Figure 7:
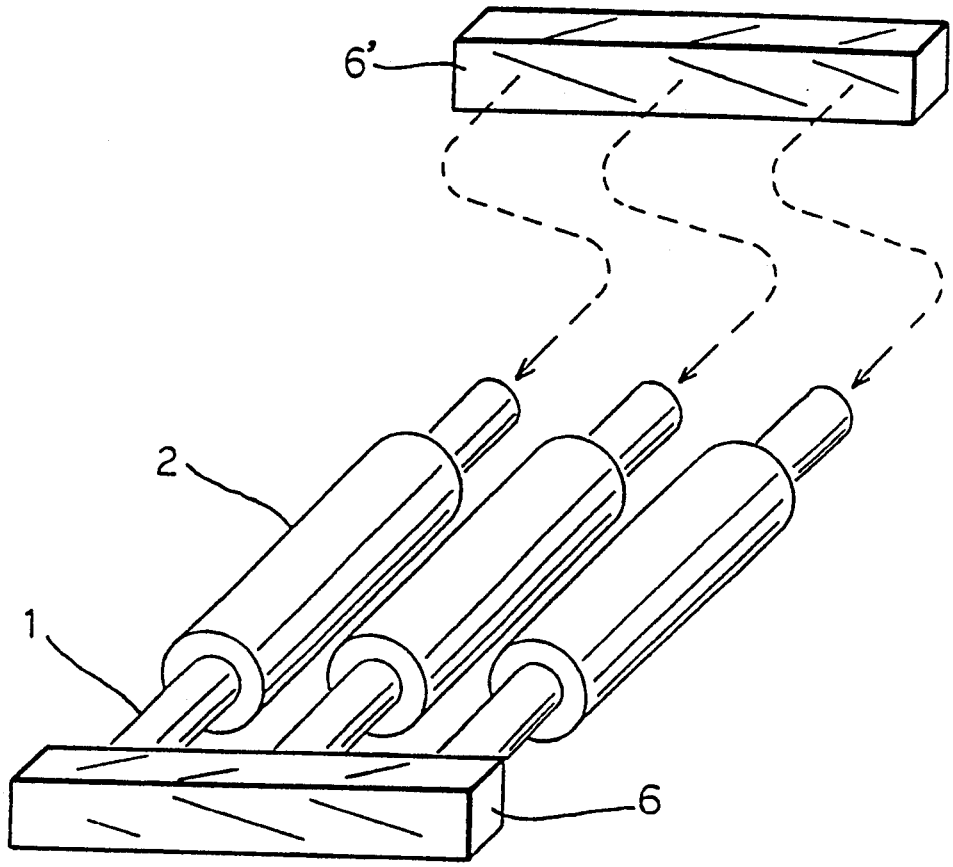
FIG. 7 is an exploded perspective view showing a magnetic circuit comprised of cores and coils used in low-frequency induction heating cooking device using the low-frequency induction heater according to the present invention.

FIG. 6 is a perspective view showing the cooking device. As shown, the cooking device 5 has three spaced-apart conductive hollow cylindrical members 3 disposed inside and integrated therewith. A core 1 and a coil 2 as shown in FIG. 7 are inserted inside each of the conductive hollow cylindrical members 3. The individual cores 1 have their opposite ends coupled together by cores or yokes 6 and 6' to form a magnetic circuit.

Where the cooking device 5 has a small volume, a single conductive hollow cylindrical member 3 may be sufficient. Where the device 5 has a large volume, four or more conductive hollow cylindrical members may be provided to preclude temperature distribution fluctuations of water or oil in the cooking device. In general, the larger the diameter of the device and more conductive hollow cylindrical members 3, the larger the heat transfer surface area of the members 3. Thus the heat transfer efficiency is the more satisfactory and oxidation of oil due to a localized temperature rise is prevented.

Figure 8A:
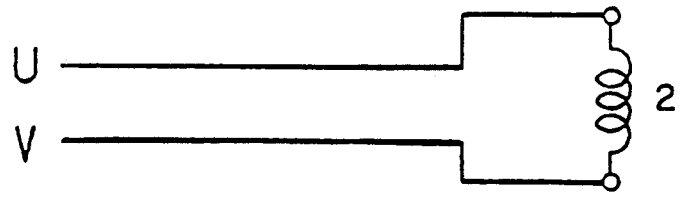
FIGS. 8(*a*) to 8(*c*) are electric connection diagrams.
Figure 8B:
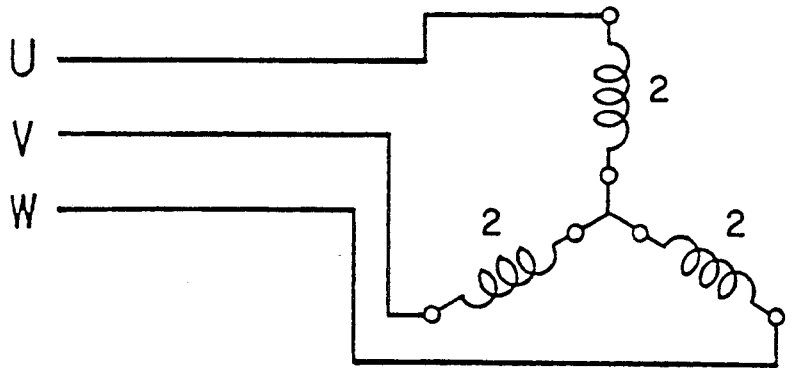
Figure 8C:
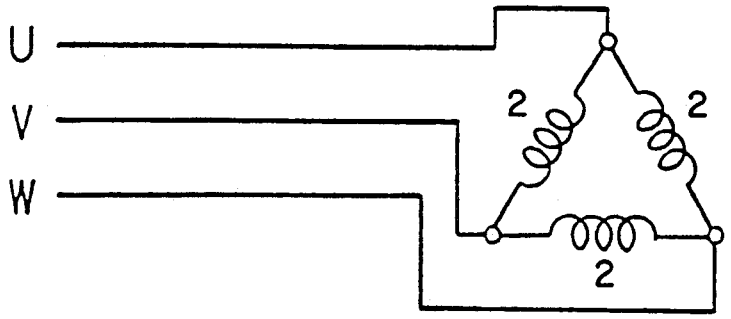

FIGS. 8(*a*) to 8(*c*) show examples of electric connection of a coil or coils 2. FIG. 8(*a*) is a connection diagram where a single-phase AC current passes through the coil 2. FIG. 8(*b*) is a connection diagram where a three-phase AC current passes through the three coils 2 in Y-connection. FIG. 8(*c*) is a connection diagram where a three-phase AC current passes through the three coils 2 in delta-connection.

Where the low-frequency induction heater according to the present invention is energized with a three-phase AC current, the input capacity of the primary side in passing a three-phase AC current preferably ranges 1 kw to 100 kW per three coils.

Figure 9:
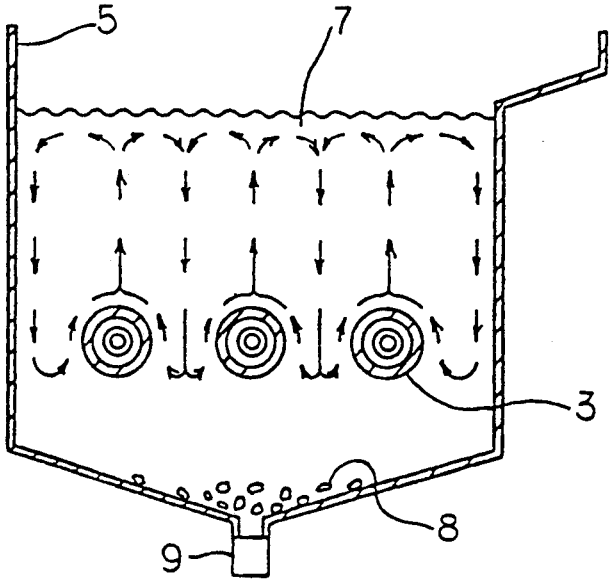
FIG. 9 is a sectional view showing the low-frequency induction heating cooking device using the low-frequency induction heater according to the present invention to heat a contained liquid such as water or oil.

FIG. 9 is a sectional view showing the low-frequency induction heating cooking device using the low-frequency induction heater according to the present invention heating a contained liquid such as water or oil. The feature labelled with the numeral 9 is a valve.

The conductive hollow cylindrical members 3 are provided in an intermediate portion of the cooking device 5 in the height direction thereof. The conductive hollow cylindrical members 3 are heated by Joule heat generated by induced current transfer and transfers heat to the surrounding liquid 7 such as water or oil. As the liquid 7 is heated, its specific gravity is reduced. Thus, the heated liquid moves upward, causing the unheated liquid 7 to be brought in the neighborhood of the conductive hollow cylindrical members 3. Through the phenomenon of convection, the liquid 7 is heated efficiently.

To effect uniform heating of a predetermined cooking material, the current passed through the coils is controlled to maintain a constant temperature by detecting the temperature with the temperature sensor provided at a predetermined position and comparing the detected temperature with a preset temperature.

A holding member for holding the cooking material, for instance, a metal net or rack, may be disposed between the conductive hollow cylindrical members 3 and the liquid surface, to support the cooking material such as fries or the like. Alternatively, noodles or like cooking material may be put into a metal basket or vessel which may be placed into the liquid 7 for cooking.

The liquid 7 below the conductive hollow cylindrical members 3 does not substantially participate in the by convection by heating and tends to stay at a temperature lower than the liquid 7 which is above the conductive hollow cylindrical members 3. Accordingly, cooking residue 8 or foreign liquid produced during the cooking is not heated convection, but collects on the bottom of the cooking vessel 5. Thus, it is not in contact with the cooking material and the cooking can be finished satisfactorily.

Figure 10A:
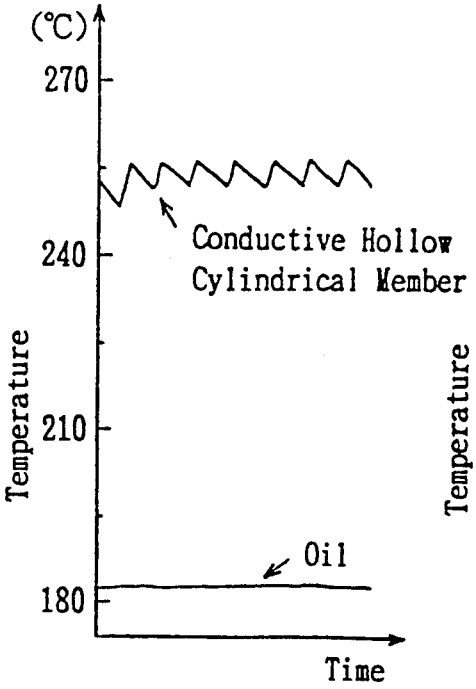
FIGS. 10(*a*) and 10(*b*) are graphs showing temperature variations in the low-frequency induction heating cooking device filled with oil using the low-frequency induction heater according to the present invention.
Figure 10B:
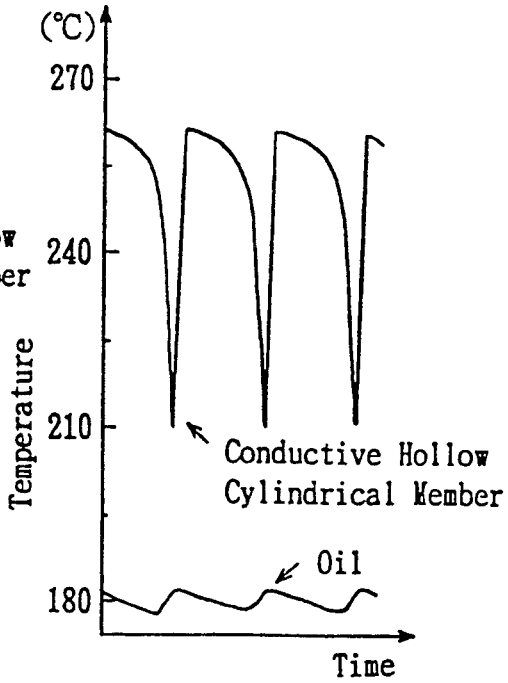
Figure 11A:
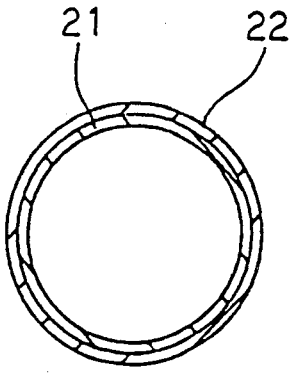
FIG. 11(a) (PRIOR ART)
FIGS. 11(*a*) and 11(*b*) are sectional views showing formation of an air gap between a copper pipe and a stainless steel pipe.
Figure 11B:
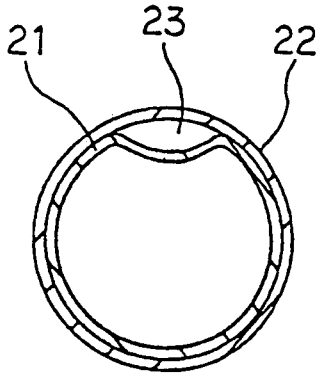
FIG. 11(b) (PRIOR ART)

FIG. 10 shows graphs of temperature change in the low-frequency induction heating cooking device full of oil. using the low-frequency induction heater according to the present invention. FIG. 10(*a*) is a graph of the output of the temperature sensor positioned inside the conductive hollow cylindrical member which is an input signal to the temperature control. FIG. 10(*b*) is a graph of the output of a temperature sensor disposed in the neighborhood of a place, where the cooking material is supported, which is an input signal to the temperature control.

In the oil temperature detection system shown in FIG. 10(*b*), the temperature change of the conductive hollow cylindrical member is about 50° C., and the temperature change of the oil is about 5° C. In contrast, in the conductive hollow cylindrical member temperature detection system shown in FIG. 10(*a*), the temperature change of the conductive hollow cylindrical member is about 5° C. and the temperature change of the oil is about 1° C. Thus, highly accurate temperature control can be realized.

As has been described in the foregoing, by using the low-frequency induction heater according to the present invention, it is possible to obtain a satisfactory efficiency of energy transfer from the conductive hollow cylindrical member to the liquid in the container. It is thus possible to improve the rate of temperature rise and reduce the time from the start of energization until the start of cooking. In addition, power supplied to the primary side can be used efficiently to the liquid in the container. It is thus possible to prevent a localized temperature rise and obtain an energy sinking effect. Further, since the conductive hollow cylindrical member is made of a single material, strain or deformation due to temperature rise or electrolytic corrosion due to leakage current is prevented. Thus, it is possible to provide a heater that has a satisfactory life and durability.

Further, by forming the conductive hollow cylindrical member of stainless steel with a thickness ranging from 2 mm to 6 mm, it is possible to prevent reduction of the Joule heat generation efficiency. In addition, it is possible to improve the mechanical strength. Thus deformation or strain during cooking or cleaning of the cooking device is prevented.

Further, with a temperature sensor or the like provided inside the conductive hollow cylindrical member, it is possible to maintain a constant heating temperature of the conductive hollow cylindrical member. Thus, cooking under a stabilized temperature condition is possible.

Further, because the number of layers of the primary winding coil ranges from 1 layer to 2 layers, it is possible to minimize the temperature rise of the primary winding and prevent an accident caused by defective insulation of an insulator in the primary winding. Thus, the reliability of the product is improved.

Further, by using the low-frequency induction heating cooking device using the low-frequency induction heater according to the present invention, quick heating is obtained while preventing a localized temperature rise of water or oil in the cooking vessel. Particularly, it is possible to prevent deterioration of the cooking oil and extend its period of use.

I claim:

1. A low-frequency induction heater, comprising:

a primary winding coil having a core, said primary winding comprising a wire made of aluminum, said core having a coil shape and being laminated with a high magnetic permeability material plate, said core having a slit in the axial direction; and a secondary winding conductive hollow cylindrical member surrounding said primary winding coil;

said conductive hollow cylindrical member consisting of a stainless steel material having a thickness ranging from 2 mm to 6 mm.

2. The low-frequency induction heater according to claim 1, wherein a temperature sensor is provided inside said conductive hollow cylindrical member.

3. The low-frequency induction heater according to claim 2, wherein said temperature sensor is a thermocouple.

4. The low-frequency induction heater according to claim 2 or 3, wherein said temperature sensor is provided inside an upper portion of said secondary winding conductive hollow cylindrical member.

5. The low-frequency induction heater according to claim 1, wherein said core is made of silicon steel plate.

6. The low-frequency induction heater according to claim 1, wherein the outer diameter of said core ranges from 10 mm to 200 mm.

7. The low-frequency induction heater according to claim 1, wherein the length of said core ranges from 100 mm to 2,000 mm.

8. The low-frequency induction heater according to claim 1, wherein the number of layers of said primary winding coil is in a range of 1 layer to 2 layers.

9. The low frequency induction heater of claim 8, wherein said primary winding coil comprises aluminium wire.

10. The low-frequency induction heater according to claim 1, wherein said primary winding coil comprises aluminium wire.

11. The low-frequency induction heater according to claim 1, 8 or 10, wherein the diameter of said wire comprised in said primary winding coil is in a range of 2 mm to 8 mm.

12. The low-frequency induction heater according to claim 8 or 10, wherein the number of turns of said wire in a first layer in said primary winding coil ranges from 50 turns to 200 turns.

13. The low-frequency induction heater according to claim 8 or 10, wherein the number of turns of said wire in a second layer in said primary winding coil ranges from 10 turns to 70 turns.

14. The low frequency induction heater of claim 10, wherein the diameter of the wire of said primary winding coil ranges from 2 mm to 8 mm.

15. The low frequency induction heater of claim 10, wherein the number of turns in a first layer in said primary winding coil ranges from 50 turns to 200 turns.

16. The low frequency induction heater of claim 10, wherein the number of turns in a second layer in said primary winding coil ranges from 10 turns to 70 turns.

17. The low-frequency induction heater according to claim 1, wherein the length of said secondary winding conductive hollow cylindrical member ranges from 100 mm to 2,000 mm.

18. The low-frequency induction heater according to claim 1, wherein the outer diameter of said secondary winding conductive hollow cylindrical member ranges from 30 mm to 300 mm.

19. The low-frequency induction heater according to claim 1, wherein an electric power supplied to said primary winding coil is switched on or off at the zero crossing point of the voltage or current.

* * * * *